United States Patent [19]

Wallis et al.

[11] 4,238,280

[45] Dec. 9, 1980

[54] PHOTOGRAPHIC SUPPORT

[75] Inventors: Roger E. Wallis, Hyde Heath, near Amersham; Michael R. Chamberlain, High Wycombe, both of England

[73] Assignee: The Wiggins Teape Group Limited, Basingstoke, England

[21] Appl. No.: 957,192

[22] Filed: Nov. 2, 1978

[30] Foreign Application Priority Data

Nov. 10, 1977 [GB] United Kingdom ..... 46910/77

[51] Int. Cl.[3] ..... 021H 5/20

[52] U.S. Cl. ..... 162/157 R; 162/206; 162/207; 162/188; 430/538

[58] Field of Search ..... 162/157 R, 206, 207, 162/188; 428/409, 516; 430/527, 538, 532; 204/148

[56] References Cited

U.S. PATENT DOCUMENTS

| | | | |
|---|---|---|---|
| 2,999,788 | 9/1961 | Morgan | 162/146 |
| 3,100,733 | 8/1963 | Bundy | 162/108 |
| 3,635,713 | 1/1972 | Van Paesschen | 96/85 |
| 3,702,258 | 11/1972 | Gibbons et al. | 204/168 |

FOREIGN PATENT DOCUMENTS

| | | | |
|---|---|---|---|
| 2303180 | 8/1973 | Fed. Rep. of Germany . | |
| 2303604 | 8/1973 | Fed. Rep. of Germany . | |
| 2358506 | 2/1976 | Fed. Rep. of Germany . | |
| 2600596 | 7/1976 | Fed. Rep. of Germany . | |
| 45-31683 | 10/1970 | Japan | 162/129 |
| 1043703 | 9/1966 | United Kingdom . | |
| 1386982 | 3/1975 | United Kingdom . | |
| 1466030 | 3/1977 | United Kingdom . | |

OTHER PUBLICATIONS

"SWP" Crown Zellerbach Brochure, Jan. 24, 1972.
"SWP" Crown Zellerbach Brochure, Sep. 1974.

*Primary Examiner*—William F. Smith
*Attorney, Agent, or Firm*—Shlesinger, Arkwright, Garvey and Dinsmore

[57] ABSTRACT

A photographic support is produced by heat consolidating paper made wholly of thermoplastic synthetic fibres. The consolidation is carried out in such a way as to produce a homogeneous surface film having a desired surface finish for receiving a photographic coating, a fully bonded but still fibrous layer adjacent the film, and a lightly bonded fibrous layer adjacent the fully bonded fibrous layer. The homogeneous surface film is produced in such a manner that its surface is substantially free of pits. This may be achieved by consolidating the web by heating it on one surface while cooling it on the other surface.

24 Claims, 2 Drawing Figures

PHOTOGRAPHIC SUPPORT

Figure 1:
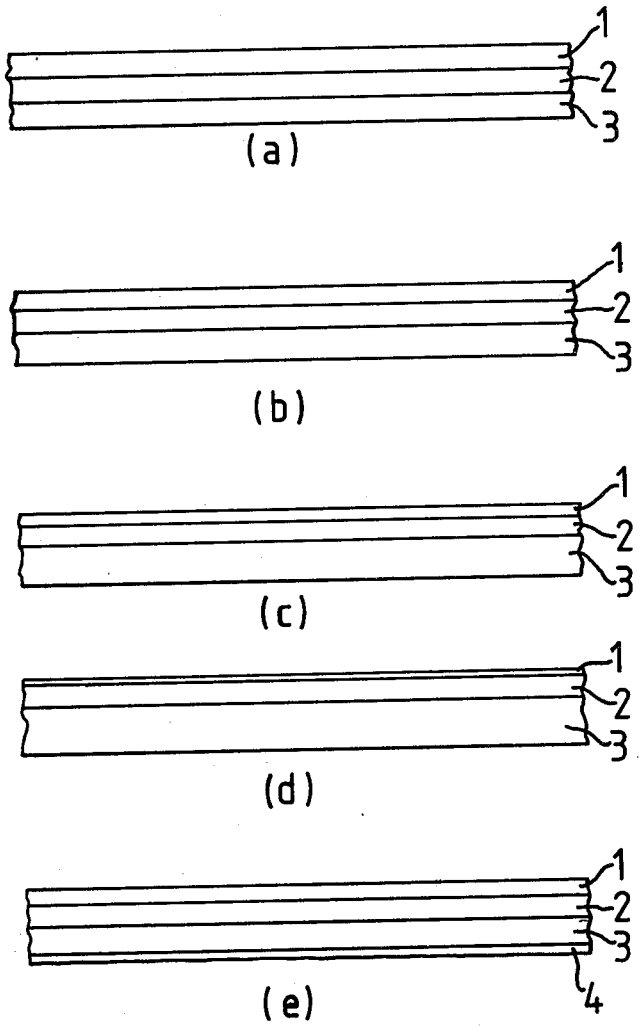

This invention relates to a photographic support produced by heat treatment of paper made wholly of thermoplastic synthetic papermaking fibres.

The use of synthetic fibres in papermaking has long been known, but has not hitherto been widespread. One reason for this is that the fibres originally proposed for this purpose were so dissimilar from conventional cellulosic fibres in their morphology and properties that it was difficult, if not impossible, to make a good quality paper sheet from them. In recent years however, synthetic fibres have become available which more closely resemble cellulosic fibres and hence offer a greater potential than the synthetic fibres proposed earlier. The newer types of synthetic fibres for use in papermaking (referred to hereafter as synthetic papermaking fibres) and often referred to as synthetic pulp, are generally of polyolefins such as polyethylene and polypropylene and are sold for example under the designations "SWP" by Crown Zellerbach and "Pulpex" by Solvay.

Polyolefinic fibres are thermoplastic, and hence a paper sheet made wholly or in part from polyolefinic synthetic papermaking fibres may be heat treated to provide a sheet with properties which are considerably different from those of conventional paper, and which in some cases are more akin to those of plastics film. In general, heat treated synthetic paper is stronger than wholly cellulosic paper of the same grammage as the synthetic paper (grammage is the weight per unit area). A further property of polyolefinic fibres which distinguishes them from cellulose fibres is their hydrophobicity.

The hydrophobicity and heat bonding potential of thermoplastic synthetic papermaking fibres render the fibres particularly suitable for certain speciality products such as photographic supports. Amongst the characteristics which a photographic support should desirably have are a substantially blemish-free surface (glossy, matt or patterned) for receiving an even coat-weight photographic coating, a high degree of purity so as to be non-reactive with photographic emulsions, sufficient strength and flexibility to withstand coating operations, sufficient rigidity to enable the finished print to be conveniently handled by the end user, sufficient wet strength to withstand treatment with water and photographic processing solutions (i.e. developing solutions which are highly alkaline and fixing solutions which are highly acidic), and good dimensional stability and low absorption when treated with water and the photographic processing solutions just referred to. A high surface opacity is also necessary in order that the final photographic print has good definition. This is usually achieved by the use of additives such as titanium dioxide.

Pigmented paper, particularly baryta-coated paper has traditionally been used as a photographic support, even though it does not completely satisfy all the requirements quoted above, for example the requirements for high wet strength, good dimensional stability and low absorption when treated with photographic processing solutions. In more recent years, polymer coated paper has come into widespread use as a photographic support. The polymer coating shields the paper from photographic processing solutions and affords a good surface for coating with photographic emulsion. Such polymer coated paper itself has a number of drawbacks, for example in that photographic processing solutions can still be absorbed into the support at its edges, which may lead to staining, in that the fibrous structure of the paper may "show-through" the polymer coating and give rise to a blemished surface, and in that there may be a tendency of the polymer coating to de-laminate from the paper. It has been proposed to overcome these problems by incorporating a proportion of synthetic papermaking fibres into the paper before polymer coating, but this does not completely solve the problem of "show-through" of cellulose fibres. It also increases the cost of the product at current cost levels.

It might be thought that the presence of paper, which appears to be the cause of the problems just mentioned, was unnecessary, and that a polymer film would itself meet the requirements of a photographic support. However, it has been found that polymers which are sufficiently cheap to be economic for most purposes tend to be too flexible or "floppy" to be acceptable to the end user (since the paper which previously afforded the necessary rigidity is no longer present), or that the polymers contain materials which are not inert to photographic coatings, or both. Polymers which might be able to meet the rigidity and inertness requirements have hitherto been too expensive for widespread use, although they have been used for certain speciality applications.

There is thus a demand for an improved photographic support. The potential of heat treated paper derived wholly or in part from thermoplastic synthetic papermaking fibres has previously been recognised in broad terms, not only for the polymer coated products already discussed but also for products which are not to be polymer-coated. Synthetic papermaking fibres with a sufficiently high degree of purity to be non-reactive with photographic emulsions can be obtained. The hydrophobicity of the fibres renders the web less absorptive to water and photographic processing solutions than wholly cellulosic paper. Heat treatment so as to bond the fibres together would enhance both the wet and dry strength of the paper. However, it is not easy using synthetic papermaking fibres to achieve a combination of all the properties which a photographic support should desirably have. For example, if heat treatment is carried out in conjunction with a conventional pressing or embossing operation, the effect is to squash together and fully or almost fully consolidate the fibres of the paper, so that the fibrous character and paper-like "feel" of the original paper are diminished or even destroyed. Thus the treated product may not have the flexibility to withstand coating operations and the rigidity to enable the finished print to be conveniently handled by the end user. A further effect of completely consolidating the paper is to reduce or eliminate its opacity. This is because opacity is derived in large measure from the presence of interstices between the fibres of the paper, and if these are eliminated, opacity is diminished.

If, as an alternative to hot pressing, the paper is heat treated without the application of pressure or with only light pressure, the effect is largely determined by the temperature and duration of the heating operation. Under mild heating conditions, i.e. a temperature not greatly in excess of the softening temperature of the fibres for a fairly short heating time, the fibres of the paper run together at their points of contact so as to produce a mesh which on a micro-scale is very rough as a result of the presence of interstices between the bonded fibres of the mesh, the interstices remaining as "pits" in the surface. Under more severe heating conditions, i.e. a higher temperature and/or a longer heating time, the surface fibres of the paper may become thoroughly molten and coalesce so as to reduce the incidence of "pit" formation, but sufficient heat tends to be transmitted through the paper during this period to cause bonding and at least partial consolidation of the fibres in other parts of the paper. As previously discussed, this has the effect of lessening the desired paper-like character and "feel" of the product, and its opacity. A further problem associated with severe heating conditions is that the product may cease to be self-supporting, which leads to considerable practical problems in handling the product.

Many of the aforementioned problems have been overcome by proposals put forward in pending British Patent Application No. 1422/75, the German counterpart of which has been published as Offenlegungsschrift No. 2,600,596. Offenlegungsschrift No. 2,600,596 discloses a method of continuously consolidating and surface finishing a web of intermeshed fibres, at least a proportion of which are of a synthetic thermoplastic material, comprising the steps of heating the web to a temperature above the softening point of the synthetic thermoplastic material, and subsequently cooling the web from a temperature above the softening point of the synthetic thermoplastic material to a temperature below the softening point of the synthetic thermoplastic material while the web is in contact with a forming surface, whereby the finish of the forming surface is imparted to the surface of the web during cooling thereof, the web being supported but not subjected to substantial pressure throughout the time it is above the softening point of the synthetic thermoplastic material. Apparatus for carrying out the method is also disclosed.

Although the proposals made in Offenlegungsschrift No. 2,600,596 represent a considerable advance, it has been found that a residual roughness or "pitting" may sometimes remain on the surface of the treated product as a result of the interstices not having been completely filled by coalescence of the softened thermoplastic material. The presence of "pits" prevents the application of a photographic coating at an even coatweight over the whole area of the treated product.

It has now been found that the problem of pitting can be obviated or at least mitigated provided sufficient heat is applied to the surface of the paper to render fibres adjacent the surface completely molten so as to destroy the fibrous structure and produce a substantially homogeneous surface film, and provided heat is also removed from the opposite surface of the paper so as to prevent consolidation of the paper throughout its whole thickness.

According to a first aspect of the invention, there is provided a photographic support produced by heat treatment of paper made wholly of thermoplastic synthetic papermaking fibres, characterised in that the support comprises a substantially homogeneous surface film with a desired surface finish for receiving a photographic coating, a first fibrous layer adjacent said surface film, the fibres in said first fibrous layer being substantially fully-bonded by virtue of being fused at their regions of contact, and a second fibrous layer adjacent said first fibrous layer, the fibres in said second fibrous layer being only lightly-bonded at their points of contact, and in that said surface film has a true % pitting (Pt) of not more than about 10%, where $P_t$ is given by the expression $P_t=(P_m-P_a)$, $P_m$ being the measured % pitting and $P_a$ being the apparent % pitting, $P_m$ being given by the expression $(R_1-R_2)/R_1\times 100$ where $R_2$ is the reflectance of the surface film after the surface film has been smeared with microcontour ink which has then been wiped off and $R_1$ is the reflectance of the surface film before such smearing is carried out and $P_a$ being given by the expression $(R_3-R_4)/R_3$ where $R_4$ is the reflectance of a heat consolidated wholly synthetic paper surface known to be pit-free after the surface has been smeared with microcontour ink which has then been wiped off and $R_3$ is the reflectance of the surface before such smearing is carried out. It will be appreciated that there is a gradual transition from the surface film to said first fibrous layer, rather than a distinct interface, and a similar gradual transition from said first fibrous layer to said second fibrous layer. The desired surface finish may for example be glossy, matt or patterned. The invention also extends to the support when carrying a photographic coating (the expression "photographic coating" in this specification embraces not only a coating of light-sensitive emulsion but also a coating of an emulsion sensitive to other electro-magnetic radiation and a coating of image-receiving layer for use in the so-called diffusion or chemical-transfer photographic process).

According to a second aspect of the invention, there is provided a process for producing a photographic support by heat treating paper made wholly of thermoplastic synthetic papermaking fibres, characterised in that heat is supplied to one surface of the paper, the amounts of heat so supplied and so removed being such that by the end of the process the fibres adjacent said one surface have been rendered molten and have coalesced to form a substantially homogeneous surface film having a true % pitting ($P_t$) of not more than about 10%, $P_t$ being as defined above, such that the fibres adjacent said surface film are fused together at their regions of contact to form a substantially fully-bonded first fibrous layer, and such that the fibres adjacent said other surface are only lightly bonded at their points of contact to form a lightly-bonded second fibrous layer, and in which process a desired surface finish for receiving a photographic coating is imparted to said substantially homogeneous surface film by a forming surface with which the film is in contact while it cools from a molten to a solid state.

The method specified above for the determination of the true % pitting ($P_t$) is an adaptation of a method widely used by printers to determine the smoothness of a paper surface. As stated above the method involves the use of a so-called microcontour ink or reagent. A small quantity of the microcontour ink is applied to the surface to be tested, and the ink is then thoroughly wiped off the surface straight away with a tissue. If pitting is present, some of the ink will be retained in the pits, giving rise to a residual colouration of the surface. The extent of any such residual colouration affords a measure of the extent of pitting. Although residual colouration can be assessed by the eye, it is preferable to determine its extent by means of a sensitive opacimeter, for example an Elrepho opacimeter. The reflectance of the sample before and after testing with microcontour ink is measured, giving values $R_1$ and $R_2$ respectively, from which the measured % pitting is derived from the equation set out above. By expressing the extent of pitting in this form, differences in reflectance arising from differences in the whiteness of the original sample are compensated for.

In order to compensate for differences in hue of the microcontour ink, the opacimeter measurements should be made using a complementary filter, for example a red filter in the case of a blue microcontour ink.

In practice, it is found that the reflectance of even a completely pit-free glossy surface is less after the application and removal of microcontour ink than it was before testing, presumably because small amounts of the ink remain as a thin smear over the surface. This effect can be thought of as giving rise to an apparent % pitting (Pa) even if no pitting is actually present. The effect is particularly noticeable with matt or embossed surfaces since they contain relatively depressed portions which tend to trap the ink. In order to compensate for this, it is necessary to measure the apparent % pitting (Pa) by making measurements on a support which can be reliably assumed to be pit free. Such a support is obtained by completely heat consolidating a wholly synthetic paper web (preferably the same paper as that from which the support according to the invention is made) under conditions such that no fibrous structure remains at all. The microcontour ink test is then carried out in a similar manner to that described above for obtaining Pm, to give reflectance values $R_3$ and $R_4$ where $R_4$ is the reflectance of the pit-free surface after smearing with microcontour ink and wiping off, and $R_3$ is the reflectance before smearing. Pa is then given by the expression $(R_3-R_4)/R_3\times 100$. As previously stated, a measure of actual or true % pitting ($P_t$) is then given by the expression $P_t=(P_m-P_a)$. This expression holds true for glossy, matt or embossed surfaces, but it will be appreciated that $P_a$ must be determined for a support of the same surface finish as that for which $P_t$ is being determined. Because $P_a$ is greater for embossed surfaces than for matt or glossy surfaces, the value of $P_t$ measured in this way is correspondingly less accurate, but this is not important.

In this specification, subsequent references to % pitting are to $P_t$ as defined above unless otherwise stated. Although a $P_t$ value of up to about 10% can be tolerated, $P_t$ is preferably zero.

The present process can be carried out using various types of apparatus. For example a batch process can be carried out with an apparatus having two plates between which the paper can be placed and heated on one surface by one of the plates and cooled on the other surface by the other of the plates (in such an apparatus the surface of the heating plate constitutes the forming surface which imparts the desired surface finish to the paper). Alternatively, a continuous process can be carried out with an apparatus in which heating is brought about by wrapping the paper around a heating roll whilst cooling the exposed surface of the paper, e.g. by means of air jets or some other cooling medium. If the paper is fed through the apparatus at a sufficiently high speed, air jets may be unnecessary, and the normal rate of unforced cooling may itself be adequate to bring about the desired rate of heat removal. It will be appreciated that for heat to be removed from the unheated surface of the paper, it is not essential that it be placed in contact with a cooling member or medium e.g. air which is at or below ambient temperature. Such a cooling member or medium could be above ambient temperature but still far enough below the temperature of the heated surface of the paper to remove the requisite amount of heat from the unheated surface of the paper.

An example of a roll heating apparatus which may be used is that disclosed in pending British Patent Application No. 1422/75, which apparatus can be modified and/or operated in a manner such that sufficient heat is removed from the unheated surface of the paper by the use of air cooling jets or otherwise. In such an apparatus, the forming surface is constituted by the surface of a subsequent forming roll, sufficient heat being carried by the heat-treated paper after leaving the heating roll for the web surface still to be soft when it contacts the forming roll surface.

Prior to the heat treatment step, a pre-treatment may be carried out to consolidate partially the paper surface to which heat is later to be supplied. Such a pretreatment may be carried out, for example, by means of heat or solvent treatment of the paper.

If desired, the surface of the support constituted by the second fibrous layer may be further treated in a subsequent operation, for example to provide an impermeable surface skin. Care must of course be taken to ensure that the whole of the second fibrous layer is not destroyed by further heat treatment, since it is essential that a lightly-bonded fibrous layer should be retained even if that layer is very thin. An advantage of imparting such a skin is that the skin shields the paper-like layer from possibly damaging contact with photographic processing or washing solutions.

If desired the paper may be sequentially heat treated by the present method on both of its surfaces to give a support having a substantially homogeneous substantially pit-free film on each of its surfaces, a substantially fully-bonded first fibrous layer adjacent each surface film, and a central lightly bonded second fibrous layer (which second layer may be very thin). Care must of course be taken to see that the surface film produced in the first treatment is not damaged in the second heat treatment (in which the first film is the cooled surface of the sheet).

In a support which has been heat treated on both its surfaces, care must be taken to ensure that the degree of bonding in the lightly-bonded central fibrous layer is sufficient to prevent ready "delamination" of the two halves of the sheet. On the other hand, the degree of bonding should not be such that no lightly-bonded layer is present at all.

The present photographic support has a surface which permits coating with an even coatweight of photographic emulsion, and in which pitting is substantially absent. The presence of the fully-bonded first fibrous layer and the lightly-bonded second fibrous layer give the support the strength and flexibility to withstand coating operations, and enable the finished print to be conveniently handled by the end user. The hydrophobic nature of the fibres make the support resistant to absorption of water and photographic processing solutions, and the presence of the surface film, and of a skin or film on the reverse surface of the web (if present), permits the support to withstand treatment with water and photographic processing solutions.

It has been found that the presence of even a small amount of cellulosic fibres in the paper to be treated prevents attainment of a surface film having a good enough surface for coating with photographic emulsion at an even coatweight to afford prints of conventional quality. Thus in making a wholly synthetic paper on a paper machine which on other occasions is used for making conventional wholly cellulosic paper, it is desirable to flush the system out thoroughly before commencing production.

The present photographic support should contain or carry the additives conventional in photographic supports. In many cases the additives may be introduced into the paper to be treated by introduction into the furnish before the paper is made, or by introduction into the fibres themselves during the fibre manufacturing operations. Such additives may include opacifiers such as titanium dioxide, optical brightening agents, antistatic agents and tinting agents. For making a photographic support, a suitable titanium dioxide content is up to 20% and preferably is in the range of 7 to 12%. A suitable optical brightening agent content is from 0 to 0.6% (all the foregoing % figures are by weight).

The surface of the photographic support may be treated by conventional means (such as corona discharge treatment) to improve adhesion of the photographic emulsion to the support. Conventional subbing treatments may also be carried out.

Figure 2:
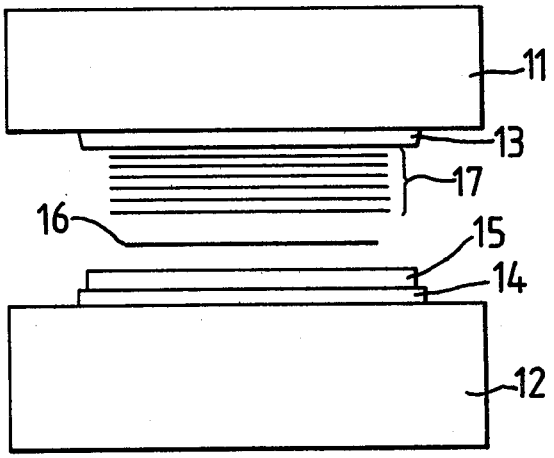

In order to enable the invention to be more readily understood, reference will now be made to the accompanying drawings, of which FIG. 1 illustrates diagrammatically and by way of example a number of heat treated sheets for use as photographic supports, and FIG. 2 illustrates, also diagrammatically and by way of example an apparatus by which the sheets shown in FIG. 1 were made.

Referring now to the drawings, FIG. 1*a* shows a sheet having a substantially homogeneous surface film 1, a substantially fully-bonded first fibrous layer 2 adjacent the film 1, and a lightly-bonded second fibrous layer 3 adjacent the layer 2. FIGS. 1*b*, 1*c* and 1*d* illustrate sheets in which the depth of the film 1 and of the layers 2 and 3 are different, as a result of a progressively greater rate of removal of heat away from the unheated surface of the web. Thus more of the sheet remains lightly-bonded and less is present as homogeneous film. FIG. 1*e* shows a sheet which, after its main heat treatment, has been further treated on its paper-like surface to produce a thin back skin 4. The surface of the skin 4 is not particularly smooth, although the irregularities in this surface have been exaggerated in FIG. 1*e*. It will be appreciated that in practice, there is not a clear interface between the film 1 and the layer 2 and between the layer 2 and the layer 3, and that instead there is a gradual transition.

Referring now to FIG. 2, there is shown apparatus for heat treating paper 16 comprising an upper and lower plates 11 and 12 respectively. The plates 11 and 12 are provided with treating portions 13 and 14 respectively, whcih stand proud of the major portions of the plates. The lower plate 12 carries on its treating portion 14 a surface finishing member 15 having the surface finish which it is desired to impart (e.g. a glossy, matt or patterned finish). The portion 14 and the member 15 may if desired incorporate respective thermo-couple temperature sensors (not shown) for measuring the temperature of the lower plate 12 and of the heated surface of the paper respectively.

In use, the lower plate 12 is heated to a desired temperature which is above the softening point of the synthetic thermoplastic fibres of which the paper 16 to be treated is made. The paper 16 is placed above the finishing member 15 and several sheets 17 of insulating material are placed between the paper 16 and the plate 11 (in FIG. 2, the paper 16 and the sheets 17 are shown suspended between the plates, for the sake of clarity). The plates are then brought together and the sample is thus heated by contact with the member 15 or the plate 12. The upper plate 11, being cool, is effective to conduct heat away from the unheated surface of the sample. The sheets 17 of insulating material serve to prevent too much heat being removed in this way. Clearly, the temperature of the plate 11 will influence the rate of heat removal, and it may be necessary to have more or less insulating material present than is shown. It may not even be necessary to have any insulating material present at all. A suitable insulating material is silicone impregnated vegetable parchment paper, for example that sold under the trade mark "Bakewell". It should be noted that the effect on heat removal does not appear to be in direct proportion to the number of sheets of insulating material used. The optimum number of sheets can however easily be determined by routine experimentation.

The sheets depicted in FIGS. 1*a* to 1*e* show a progressive increase in the lightly-bonded portion of the heat treated paper; this is achieved by a corresponding decrease in the number of sheets of insulating material.

It has been found that the principal factors which affect the structure of the heat treated sheet are the temperature of the heating plate 12, the temperature of the forming surface of the member 15, the temperature reached by the heated surface of the sample, the temperature reached by the back of the sample, and the time for which the sample is heated between the plates.

These variables are thought to be to a large extent interdependent in controlling the net rate of heat supply to the sample and hence the structure of the treated sample. It is therefore possible to control the heat treatment of the sample to a large extent by adjusting only one of those variables. In practice, it has so far been found most convenient to achieve this control by varying the amount of insulating material used as described above, but other methods of control can be used, e.g. control of heating plate and/or cooling plate temperatures and/or duration of heat treatment. The pressure applied to the sample by the plates in which it is held is also an important factor, but it should be appreciated that this pressure does not approach the order of magnitude normally found in conventional hot pressing or embossing processes. A suitable pressure is 1000 $KN.m^{-2}$, although pressures which are higher or lower than this value can be used if the other variables are compatible.

The invention will now be illustrated by the following Examples:

EXAMPLE 1

A number of papers of different grammages were made from an aqueous dispersion of thermoplastic synthetic papermaking fibres by a conventional paper making procedure. These were each heat treated as described above, but with different amounts of insulating material between the sample and the upper plate. The insulating material was "Bakewell" silicone impregnated vegetable parchment paper having a substance of 42 $g/m^2$, a thickness of about 51 $\mu m$ and a density of about 1.2. In each case, there was produced a sheet having a substantially homogeneous surface film, a substantially fully-bonded first fibrous layer adjacent the film and a lightly-bonded second fibrous layer adjacent the fully-bonded fibrous layer. The results of physical tests to determine the properties of the finished sheet are set out in Table 1. It will be noted that the tensile strength of the sheet after heat treatment is greater for a thin sheet than for a thicker sheet. This reflects the fact that the thinner sheets are consolidated across a greater proportion of their thickness, and hence include relatively more consolidated material. It will also be noted that the thinner sheets have an increased rigidity, which is contrary to the normal expectation of greater thickness imparting greater rigidity. This again demonstrates the greater extent of consolidation of the thinner sheets.

TABLE 1

| No. of sheets of "Bakewell" | Initial Grammage of paper sheet treated ($g/m^2$) | Thickness after treatment ($\mu m$) | Apparent* Density after treatment (g/cc) | Tensile after treatment (N/15 mm) | Stretch after treatment (%) | Kenley Rigidity after treatment (mN) | Pitting % ($P_t$) |
|---|---|---|---|---|---|---|---|
| 18 | 223.5 | 290 | 0.77 | 69 | 11 | 37 | 0 |
| 14 | 223.0 | 301 | 0.74 | 61 | 14 | 36 | 0 |
| 12 | 226.0 | 318 | 0.70 | 60 | 12 | 37 | 0 |
| 9 | 223.0 | 328 | 0.68 | 46 | 9 | 34 | 0 |

*By apparent density is meant the average density of the three distinct regions of the sheet.

In each case, the heating plate temperature was 147.5° C., the surface temperature of the forming member was 131.5° C. initially and 133.0° C. at the end of the heating stage (all these temperatures are thought to be accurate within plus or minus 2.5° C.), the pressure was 1000 $kNm^{-2}$ and the time for which the sample was held between the plates was 20 seconds.

The presence of a surface film, a fully-bonded first fibrous layer and a lightly-bonded second fibrous layer can be demonstrated by means of a Taber abrader, an instrument normally used for measuring the hardness or abrasion-resistance of a material. For the present purpose, its mode of operation is slightly modified compared with its normal mode of operation. The apparatus comprises a turntable on which run a pair of co-axially arranged wheels non-diametrically disposed on opposite sides of the turntable axis. The wheels are surfaced with a hard wearing abrading material. A disc of the heat treated sheet material is placed on the turntable, which is then rotated for a selected number of revolutions and thereby the pair of wheels is also rotated for a fixed number of revolutions. The senses of rotation of the two wheels are opposite, but since they are positioned on opposite sides of the axis of rotation of the turntable, they rotate in the same direction relative to the sheet under test. The effect of the contact between the pair of wheels and the sheet on the turntable is to abrade the sheet, and the rate at which this happens is determined by the hardness of the sheet under test. The rate of abrasion of the sheet under test can be measured at periodic intervals by removing it from the turntable and weighing it, and comparing this with its initial weight.

It is found that if the sample is placed with its surface film face downwards on the turntable so that the lightly-bonded second fibrous layer is face upwards and in contact with the pair of wheels, and the turntable is rotated, there is an initial fairly rapid abrasion but after a certain period, the rate of abrasion diminishes, even though the wheels have not worn entirely through the sheet. After a further period, it is found that the rate of abrasion diminishes still further and in fact virtually ceases. These results demonstrate that the lightly-bonded second fibrous layer is readily abraded (as one might expect), that the substantially fully-bonded first fibrous layer is less easily abraded, but that it is abraded over a relatively long period of time, and that the substantially homogeneous film is not abraded or is hardly abraded at all. In considering the results just described it will of course be appreciated that the extent of abrasion is also determined by the abrasive character of the surface of the wheels, and that a suitable surface must be selected. Clearly, if the surface was too abrasive, everything would be abraded very quickly and it would not be possible to make reliable observations. Wheels having a suitable surface material are those known as "Teledyne Taber Calibrase CS-10 Wheels" (when changing the abrasive surface of a Taber abrader, it is conventional to change the whole wheels rather than just their abrasive surfaces).

The presence of a lightly-bonded second fibrous layer can also be demonstrated in some cases in a more simple manner by scratching the cooled surface of the sheet with a finger-nail. Fibres are easily dislodged. However, this test is clearly not possible for a sheet which has been heat-treated on both of its surfaces.

In carrying out a finger-nail scratch test, it should be borne in mind that dislodgeability of fibres is not a definitive test for the presence of a lightly-bonded second fibrous layer. If the second fibrous layer is very thin (e.g. as a result of relatively severe heating conditions) it may not be easy to dislodge fibres, even though the degree of bonding is substantially less than in an adjacent substantially fully-bonded first fibrous layer.

EXAMPLE 2

This illustrates the production of a glossy photographic support by means of the present process at different temperature and pressures. The process was carried out generally as described in Example 1, except that the conditions used were as set out in Table 2 below, which also lists the properties of the product obtained.

TABLE 2

| Pressing Temp. (°C.) | Pressure $kNm^{-2}$ | No. of "Bakewell" Sheets | Grammage ($g/m^2$) | Thickness after pressing ($\mu m$) | Apparent Density ($g \cdot cm^{-3}$) | Tensile ($N \cdot 15\ mm^{-1}$) | Stretch % | Kenley Rigidity (mN) | Pitting* % ($P_t$) |
|---|---|---|---|---|---|---|---|---|---|
| 130 | 4050 | 10 | 230 | 250 | 0.89 | 86.7 | 10.0 | 38.5 | 0 |
| 132.5 | 1600 | 10 | 232 | 310 | 0.75 | 63.5 | 5.9 | 41.2 | 0 |

TABLE 2-continued

| Pressing Temp. (°C.) | Pressure $kNm^{-2}$ | No. of "Bakewell" Sheets | Grammage ($g/m^2$) | Thickness after pressing (μm) | Apparent Density ($g . cm^{-3}$) | Tensile ($N . 15 mm^{-1}$) | Stretch % | Kenley Rigidity (mN) | Pitting* % ($P_t$) |
|---|---|---|---|---|---|---|---|---|---|
| 135.0 | 675 | 10 | 226 | 333 | 0.68 | 68.5 | 5.2 | 41.0 | 0 |

*Pitting tests accurate to within ± 2%.

EXAMPLE 3

This illustrates the production of a matt photographic support by means of the present process at different temperatures and pressures. The process was carried out generally as described in Example 1, except that the conditions used were as set out in Table 3 below, which also lists the properties of the product obtained.

TABLE 3

| Consolidation Temperature (20°C.) | Consolidation Pressure $kN . m^{-2}$ | Number of "Bakewell" Sheets | Grammage $g/m^{-2}$ | Thickness after consolidating μm | Apparent Density $g/cm^{-3}$ | Tensile Stretch $N . 15 mm^{-1}$ | Stretch % | Kenley Stiffness mN | Pitting* % ($P_t$) |
|---|---|---|---|---|---|---|---|---|---|
| 140° | 4050 | 10 | 240 | 300 | 0.800 | 81.0 | 7.50 | 30 | 0 |
| 142.5° | 1620 | 10 | 240 | 315 | 0.762 | 78.5 | 6.60 | 29 | 0 |
| 145° | 675 | 10 | 240 | 320 | 0.750 | 78.0 | 5.90 | 32.5 | 0 |

*Pitting Test accurate to within ± 3%

EXAMPLE 4

This illustrates the production of an embossed photographic support by means of the present process at different temperatures and pressures. The process was carried out generally as described in Example 1, except that the conditions used were as set out in Table 4 below, which also lists the properties of the product obtained.

TABLE 4

| Consolidation Temperature (°C.) | Consolidation Pressure $KN . m^{-2}$ | Number of "Bakewell" Sheets | Grammage $g/m^{-2}$ | Thickness after consolidating μm | Apparent Density $g/cm^{-3}$ | Tensile Strength $n . (15 mm^{-1}$ | Stretch % | Kenley Stiffness mN | Pitting* % ($P_t$) |
|---|---|---|---|---|---|---|---|---|---|
| 135° | 4050 | 10 | 244 | 280 | 0.871 | 89.0 | 16.4 | 28.5 | 0 |
| 139.5° | 1620 | 10 | 244 | 285 | 0.856 | 88.0 | 16.2 | 29.5 | 0 |
| 140° | 675 | 10 | 244 | 310 | 0.787 | 86.0 | 16.4 | 33.5 | 0 |

*Pitting test accurate to within ± (4%

EXAMPLE 5

This illustrates the effect of pressure and temperature on the extent of surface pitting, and the need to select compatible temperatures and pressures. The process was carried out generally as described in Example 1, except that the conditions were as set out in Table 5 below, which also lists the % pitting for each of the products obtained.

TABLE 5

| Pressure kPa \ Temperature °C. | 127.5° | 130° | 132.5° | 135° | |
|---|---|---|---|---|---|
| 270 | 84 | 73 | 62 | 15 | |
| 675 | 74 | 44 | 17 | 0 | % Pitting ($P_t$) |
| 1600 | 42 | 25 | 0 | 0 | |
| 4050 | 21 | 7 | 0 | 0 | |

We claim:

1. A photographic support produced by heat treatment of paper made wholly of thermoplastic synthetic papermaking fibres, said support comprising:

a substantially homogeneous surface film with a surface finish for receiving a photographic coating;

a first fibrous layer adjacent said surface film, the fibres in said first fibrous layer being substantially fully-bonded by virtue of being fused at their regions of contact; and, a second fibrous layer adjacent said first fibrous layer, said second fibrous layer having an impermeable surface skin and the fibres in said second fibrous layer being only lightly-bonded at their points of contact;

said surface film having a true % pitting ($P_t$) of not more than about 10%, where $P_t$ is given by the expression $P_t=(P_m-P_a)$, $P_m$ being the measured % pitting and $P_a$ being the apparent % pitting, $P_m$ being given by the expression $(R_1-R_2)/R_1\times 100$ where $R_2$ is the reflectance of the surface film after the surface film has been smeared with microcontour ink which has then been wiped off and $R_1$ is the reflectance of the surface film before such smearing is carried out and $P_a$ being given by the expression $(R_3-R_4)/R_3\times 100$ where $R_4$ is the reflectance of a heat consolidated synthetic paper surface known to be pit-free after the surface has been smeared with microcontour ink which has then been wiped off and $R_3$ is the reflectance of the surface before such smearing is carried out.

2. A photographic support produced by heat treatment of paper made wholly of thermoplastic synthetic papermaking fibres, said support comprising:

a first substantially homogeneous surface film, said first surface film having a surface finish for receiving a photographic coating;

a second substantially homogeneous surface film at the other surface of said support;

a first fibrous layer adjacent said first surface film, the fibres in said first fibrous layer being substantially fully-bonded by virtue of being fused at their regions of contact;

a second fibrous layer adjacent said first fibrous layer, the fibres in said second fibrous layer being only lightly-bonded at their points of contact; and, a third fibrous layer adjacent said second surface film, the fibres in said third fibrous layer being substantially fully-bonded by virtue of being fused at their regions of contact, said second fibrous layer being centrally located between said first and third fibrous layers;

at least one of said surface films having a true % pitting ($P_t$) of not more than about 10%, where $P_t$ is given by the expression $P_t=(P_m-P_a)$, $P_m$ being the measured % pitting and $P_a$ being the apparent % pitting, $P_m$ being given by the expression $(R_1-R_2)/R_1\times 100$ where $R_2$ is the reflectance of the surface film after the surface film has been smeared with microcontour ink which has then been wiped off and $R_1$ is the reflectance of the surface film before such smearing is carried out and $P_a$ being given by the expression $(R_3-R_4)/R_3\times 100$ where $R_4$ is the reflectance of a heat consolidated synthetic paper surface known to be pit-free after the surface has been smeared with microcontour ink which has then been wiped off and $R_3$ is the reflectance of the surface before such smearing is carried out.

3. A process for producing a photographic support by heat treatment of paper made wholly of thermoplastic synthetic papermaking fibres, comprising:

supplying heat to one surface of a paper sheet made wholly of thermoplastic synthetic papermaking fibres;

simultaneously removing heat from the other surface of said sheet;

controlling the amounts of heat being supplied and removed so as to render molten and subsequently coalesce the fibres adjacent said one surface thus forming a substantially homogeneous surface film having a true % pitting ($P_t$) of not more than about 10%, so as to fuse together at their regions of contact the fibres adjacent said surface film thus forming a substantially fully-bonded first fibrous layer, and so as to lightly-bond at their points of contact the fibres adjacent said other surface thus forming a lightly-bonded second fibrous layer, the true % pitting ($P_t$) being given by the expression $P_t=(P_m-P_a)$, $P_m$ being the measured % pitting and $P_a$ being the apparent % pitting, $P_m$ being given by the expression $(R_1-R_2)/R_1\times 100$ where $R_2$ is the reflectance of the surface film after the surface film has been smeared with microcontour ink which has then been wiped off and $R_1$ is the reflectance of the surface film before such smearing is carried out and $P_a$ being given by the expression $(R_3-R_4)R_3\times 100$ where $R_4$ is the reflectance of a heat consolidated synthetic paper surface known to be pit-free after the surface has been smeared with microcontour ink which has then been wiped off and $R_3$ is the reflectance of the surface before such smearing is carried out;

maintaining a forming surface having a predetermined surface finish in contact with said surface film while said surface film cools from a molten state to a solid state so as to impart said surface finish to said surface film; and, subsequently applying a photographic coating to said surface film.

4. The process of claim 3 wherein the fibres are polyolefin fibres.

5. The process of claim 4 wherein the fibres are polyethylene or polypropylene fibres.

6. The process of claim 3, 4, or 5 and including the preliminary step of partially consolidating said one surface of said paper to which heat is later to be applied.

7. The process of claim 3 and including the step of providing said second fibrous layer with an impermeable surface skin.

8. The process of claim 3 and including the steps subsequent to said step of maintaining said forming surface in contact with said surface film of:

supplying heat to said other surface of said sheet;

simultaneously removing heat from said one surface of said sheet; and, regulating the amounts of heat being supplied and removed so as to render molten and subsequently coalesce the fibres adjacent said outer surface thus forming a substantially homogeneous substantially pit-free surface film at said other surface and so as to fuse together at their regions of contact the fibres adjacent said surface film of said other surface thus forming a substantially fully-bonded third fibrous layer, said second fibrous layer being centrally located between said first and third fibrous layers.

9. The process of claim 3 and including the step of treating said surface film of said one surface to improve the adhesion of said photographic coating to said surface film.

10. The process of claim 3 wherein:

said heating step comprises placing said one surface of said sheet in contact with a heating means having a heating surface;

said heat removing step comprises placing said other surface in contact with a cooling means having a cooling surface; and, said heat controlling step includes placing insulating material between said other surface of said sheet and said cooling surface.

11. A process for producing a photographic support by heat treatment of paper made wholly of thermoplastic synthetic papermaking fibres, comprising:

supplying heat to one surface of a paper sheet made wholly of thermoplastic synthetic papermaking fibres;

simultaneously removing heat from the other surface of said sheet;

controlling the amounts of heat being supplied and removed so as to render molten and subsequently coalesce the fibres adjacent said one surface thus forming a substantially homogeneous surface film having a true % pitting ($P_t$) of not more than about 10%, so as to fuse together at their regions of contact the fibres adjacent said surface film thus forming a substantially fully-bonded first fibrous layer, and so as to lightly-bond at their points of contact the fibres adjacent said other surface thus forming a lightly-bonded second fibrous layer, the true % pitting ($P_t$) being given by the expression $P_t=(P_m-P_a)$, $P_m$ being the measured % pitting and $P_a$ being the apparent % pitting, $P_m$ being given by the expression $(R_1-R_2)/R_1\times 100$ where $R_2$ is the reflectance of the surface film after the surface film has been smeared with microcontour ink which has then been wiped off and $R_1$ is the reflectance of the surface film before such smearing is carried out and $P_a$ being given by the expression $(R_3-R_4)/R_3\times 100$ where $R_4$ is the reflectance of a heat consolidated synthetic paper surface known to be pit-free after the surface has been smeared with microcontour ink which has then been wiped off and $R_3$ is the reflectance of the surface before such smearing is carried out;

maintaining a forming surface having a predetermined surface finish in contact with said surface film while said surface film cools from a molten state to a solid state so as to impart said surface finish to said surface film; and, subsequently providing said second fibrous layer with an impermeable surface skin.

12. A process for producing a photographic support by heat treatment of paper made wholly of thermoplastic synthetic papermaking fibres, comprising:

supplying heat to one surface of a paper sheet made wholly of thermoplastic synthetic papermaking fibres;

simultaneously removing heat from the other surface of said sheet;

controlling the amounts of heat being supplied and removed so as to render molten and subsequently coalesce the fibres adjacent said one surface thus forming a substantially homogeneous surface film having a true % pitting ($P_t$) of not more than about 10%, so as to fuse together at their regions of contact the fibres adjacent said surface film thus forming a substantially fully-bonded first fibrous layer, and so as to lightly-bonded at their points of contact the fibres adjacent said other surface thus forming a lightly-bonded second fibrous layer, the true % pitting ($P_t$) being given by the expression $P_t=(P_m-P_a)$, $P_m$ being the measured % pitting and $P_a$ being the apparent % pitting, $P_m$ being given by the expression $(R_1-R_2)/R_1\times 100$ where $R_2$ is the reflectance of the surface film after the surface film has been smeared with microcontour ink which has then been wiped off and $R_1$ is the reflectance of the surface film before such smearing is carried out and $P_a$ being given by the expression $(R_3-R_4)/R_3\times 100$ where $R_4$ is the reflectance of a heat consolidated synthetic paper surface known to be pit-free after the surface has been smeared with microcontour ink which has then been wiped off and $R_3$ is the reflectance of the surface before such smearing is carried out;

maintaining a forming surface having a predetermined surface finish in contact with said surface film while said surface film cools from a molten state to a solid state so as to impart said surface finish to said surface film; and, subsequently supplying heat to said other surface of said sheet while simultaneously removing heat from said one surface of said sheet and regulating the amounts of heat being supplied and removed so as to render molten and subsequently coalesce the fibres adjacent said other surface thus forming a substantially homogeneous substantially pit-free surface film at said other surface and so as to fuse together at their regions of contact the fibres adjacent said surface film of said other surface thus forming a substantially fully-bonded third fibrous layer, said second fibrous layer being centrally located between said first and third fibrous layers.

13. The process of claim 12 and including the subsequent step of treating said surface film of said one surface to improve the adhesion of a photographic coating to said surface film.

14. A photographic support produced by heat treatment of paper made wholly of thermoplastic synthetic papermaking fibres, said support comprising:

a substantially homogeneous surface film with a surface finish for receiving a photographic coating;

a first fibrous layer adjacent said surface film, the fibres in said first fibrous layer being substantially fully-bonded by virtue of being fused at their regions of contact;

a second fibrous layer adjacent said first fibrous layer, the fibres in said second fibrous layer being only lightly-bonded at their points of contact;

said surface film having a true % pitting ($P_t$) of not more than about 10%, where $P_t$ is given by the expression $P_t=(P_m-P_a)$, $P_m$ being the measured % pitting and $P_a$ being the apparent % pitting, $P_m$ being given by the expression $(R_1-R_2)/R_1\times 100$ where $R_2$ is the reflectance of the surface film after the surface film has been smeared with microcontour ink which has then been wiped off and $R_1$ is the reflectance of the surface film before such smearing is carried out and $P_a$ being given by the expression $(R_3-R_4)/R_3\times 100$ where $R_4$ is the reflectance of a heat consolidated synthetic paper surface known to be pit-free after the surface has been smeared with microcontour ink which has then been wiped off and $R_3$ is the reflectance of the surface before such smearing is carried out; and, said support having a photographic coating on said surface film.

15. The photographic support of claim 14 wherein said support is composed of polyolefinic thermoplastic material.

16. The photographic support of claim 15 wherein said thermoplastic material is polyethylene or polypropylene.

17. The photographic support of claim 14, 15, or 16 wherein said second fibrous layer has an impermeable surface skin.

18. The photographic support of claim 14 and including a second substantially homogeneous film at the other surface of said support, at least one of said surface films having a true % pitting ($P_t$) of not more than about 10%, a third fibrous layer adjacent said second surface film, the fibres in said third fibrous layer being substantially fully-bonded by virtue of being fused at their regions of contact, said second fibrous layer being centrally located between said first and third fibrous layers.

19. The photographic support of claim 14 and containing at least one additive selected from the group consisting of an opacifier, an optical brightening agent, an anti-static agent, and a tinting agent.

20. The photographic support of claim 19 and containing titanium dioxide in an amount of up to 20% by weight.

21. The photographic support of claim 20 wherein said titanium dioxide is present in an amount of from 7 to 12% by weight.

22. The photographic support of claim 19, 20, or 21 and containing an optical brightening agent in an amount of up to 0.6% by weight.

23. The photographic support of claim 14 wherein said surface film has been treated for improving adhesion of said photographic coating to said surface film.

24. The photographic support of claim 14 wherein said surface film has been subjected to a corona discharge treatment for improving adhesion of said photographic coating to said surface film.

* * * * *